US007028520B2

(12) United States Patent
Birkert et al.

(10) Patent No.: US 7,028,520 B2
(45) Date of Patent: Apr. 18, 2006

(54) METHOD AND DEVICE USING HIGH INTERIOR PRESSURE TO RESHAPE STRUCTURAL SECTION

(75) Inventors: Arndt Birkert, Bretzfeld (DE); Sven Schneider, Boxberg-Windischbuch (DE)

(73) Assignee: Thyssenkrupp Automotive AG, Bochum (DE)

( * ) Notice: Subject to any disclaimer, the term of this patent is extended or adjusted under 35 U.S.C. 154(b) by 91 days.

(21) Appl. No.: 10/705,488

(22) Filed: Nov. 10, 2003

(65) Prior Publication Data

US 2004/0194523 A1 Oct. 7, 2004

(30) Foreign Application Priority Data

Dec. 6, 2002 (DE) ..... 102 57 343
May 13, 2003 (DE) ..... 203 07 400 U

(51) Int. Cl.
*B21D 11/02* (2006.01)
*B21D 26/02* (2006.01)

(52) U.S. Cl. ..... 72/61; 72/58; 72/62

(58) Field of Classification Search ..... 72/55, 72/56, 57, 58, 59, 60, 61, 62, 63
See application file for complete search history.

(56) References Cited

U.S. PATENT DOCUMENTS

| | | | | | |
|---|---|---|---|---|---|
| 2,837,810 | A * | 6/1958 | Ekholm | ..... | 72/61 |
| 3,180,011 | A * | 4/1965 | Heuer | ..... | 72/61 |
| 5,233,856 | A * | 8/1993 | Shimanovski et al. | ..... | 72/62 |
| 5,349,839 | A * | 9/1994 | Weykamp et al. | ..... | 72/61 |
| 5,363,544 | A * | 11/1994 | Wells et al. | ..... | 72/58 |
| 5,815,901 | A * | 10/1998 | Mason et al. | ..... | 72/58 |
| 6,012,317 | A * | 1/2000 | Bonny et al. | ..... | 72/61 |
| 6,763,693 | B1 * | 7/2004 | Gehrig et al. | ..... | 72/61 |

* cited by examiner

*Primary Examiner*—David Jones
(74) *Attorney, Agent, or Firm*—Max Fogiel

(57) ABSTRACT

A method using high interior pressure to reshape structural section of continuously bounded overall cross-section, whereby the overall cross-section can be provided with extra walls or chambers and a stopper is forced radially against each end of the piece. The object is to reduce wear on the stopper while ensuring that any walls or chambers in addition to its overall crosssection will buckle or bulge only at their ends.

8 Claims, 4 Drawing Sheets

METHOD AND DEVICE USING HIGH INTERIOR PRESSURE TO RESHAPE STRUCTURAL SECTION

BACKGROUND OF THE INVENTION

The present invention relates to a method using high interior pressure to reshape structural section.

The structural section being reshaped using high internal pressure may be tubing as disclosed in German 3 923 358 A1 and in U.S. Pat. No. 4,414,834 A. Pieces with a non-circular cross-section, however, can also be reshaped. Such material is usually extruded.

To ensure unobjectionable fluid tightness, a stopper is forced radially against each end of the structural section. The end of the piece rests against an edge of the stopper, creating a seal. To reduce wear on the stoppers as much as possible, the seal-creating edge is made of a wear resistant material and is forced against the interior surface of the section subject to relatively high pressure.

It would also be desirable to similarly use high interior pressure to reshape pieces with extra walls or chambers projecting into or out of their overall cross-section. There is, however, a drawback to such a procedure in that the walls or chambers tend to deform axially along the piece, allowing the edges to buckle or bulge out axially undefined. It is of course possible to counteract this tendency by making the edges of a softer material. This approach, however, increases wear on the edges.

SUMMARY OF THE INVENTION

The object of the present invention is accordingly a method of and a device for using high interior pressure to reshape structural section with walls or chambers that project into or out of its overall cross-section, whereby the stoppers are subjected to low wear and whereby the extra walls or chambers will buckle or bulge out only at their ends.

The major advantage of the present invention is that complex structural section with extra walls or chambers can be reshaped using high interior pressure, decreasing the cost of manufacture. Since the section is reshaped only slightly at the ends, they will need to be trimmed only slightly if at all as the material is further processed.

BRIEF DESCRIPTION OF THE DRAWINGS

One embodiment of the present invention will now be specified with reference to the accompanying drawing, wherein.

DESCRIPTION OF THE PREFERRED EMBODIMENTS

Figure 1:
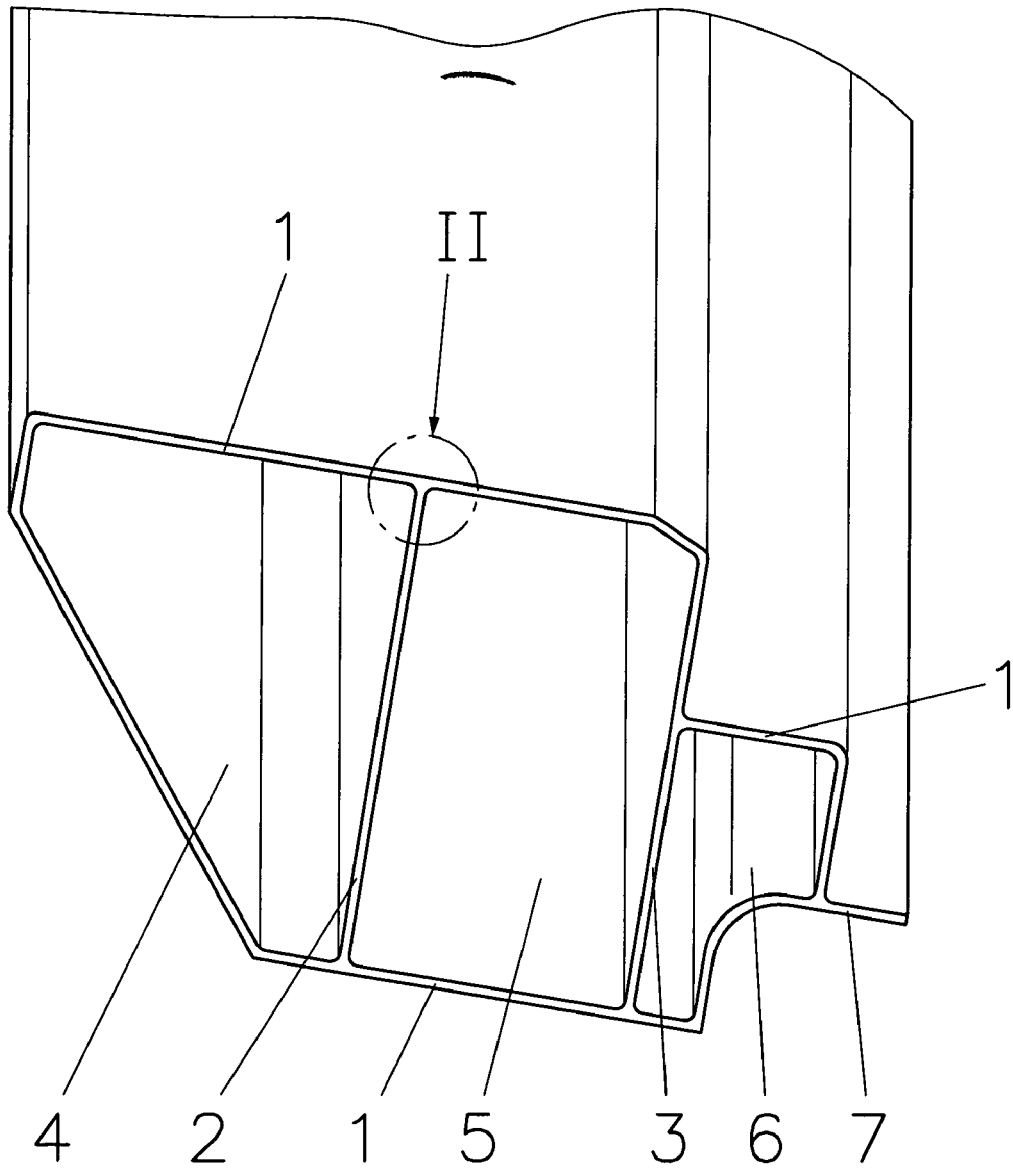
FIG. 1 is a view of one end of a length of extruded structural section with several walls.
Figure 2:
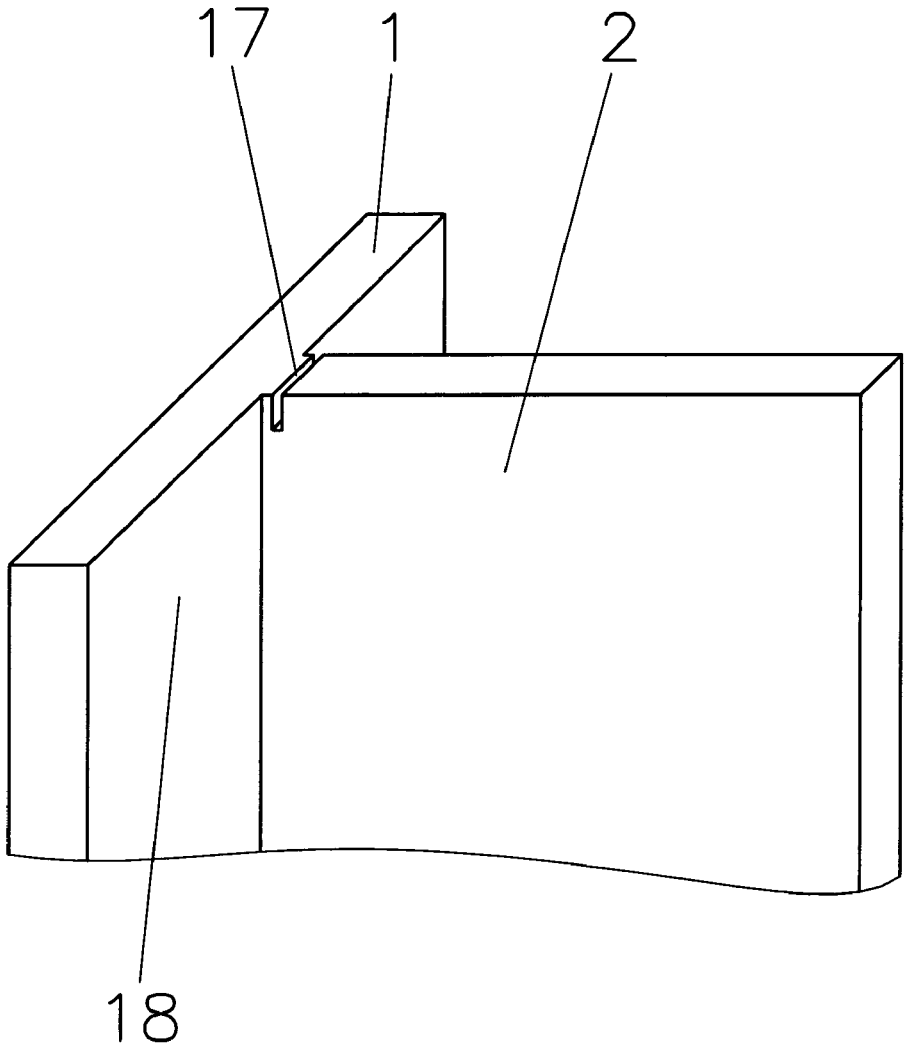
FIG. 2 is a larger-scale view of detail II in FIG. 1.
Figure 3:
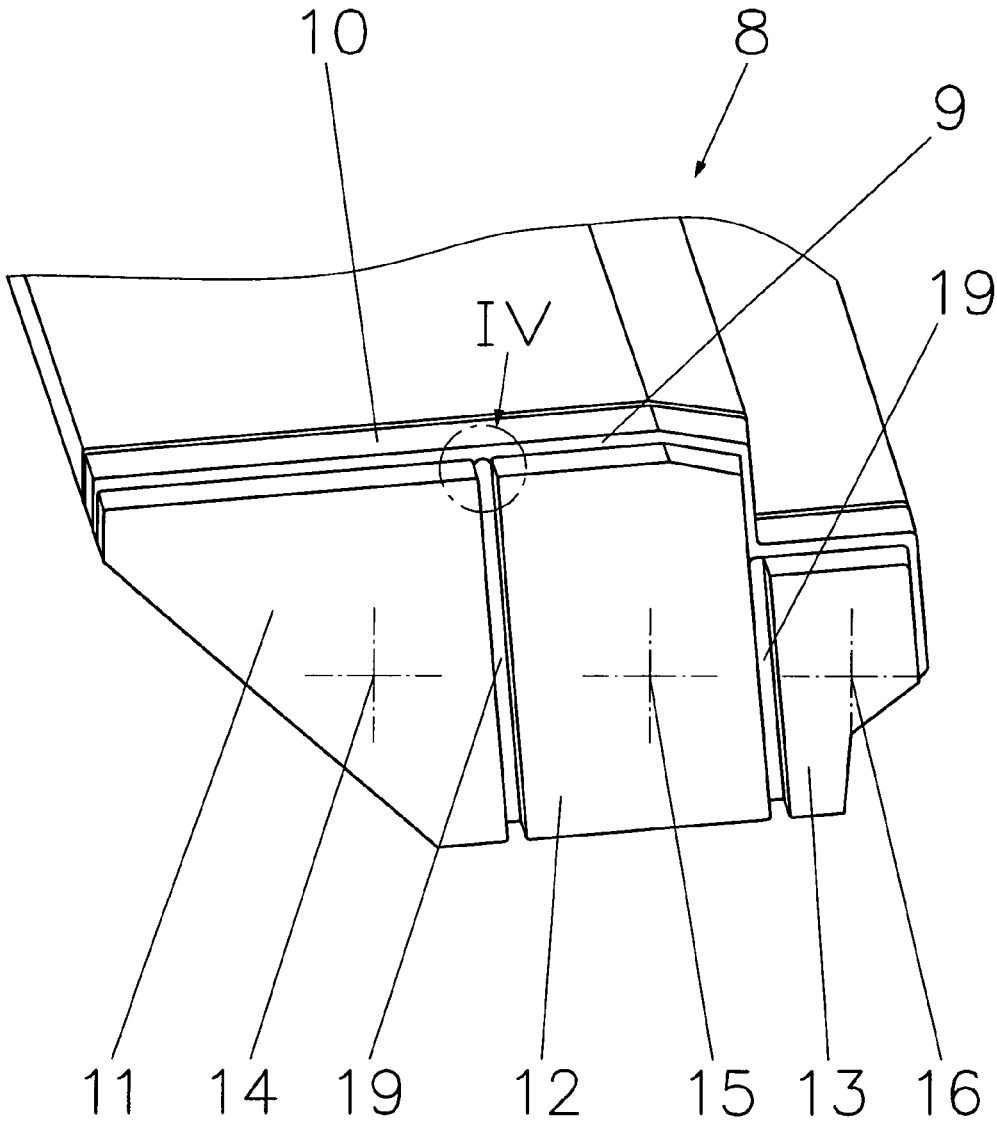
FIG. 3 illustrates a stopper sealing off the end illustrated in FIG. 1.

FIG. 1 depicts a length of typical extruded structural section that is to be reshaped using high interior pressure. The extrusion has a continuously bounded cross-section 1 partitioned by two walls 2 and 3 into three chambers 4, 5, and 6. Finally, the section is provided with an independent wall 7 that extends out of cross-section 1.

While it is being reshaped and still inside the reshaping tool, the ends of the piece are sealed by stoppers 8 forced radially against them. Each stopper 8 is provided with a seal-creating edge 9 established on the surface of a gasket 10 that rests against the stopper. Each edge 9 accordingly fits tight into the structural section. Each stopper 8 is provided with aligners 11, 12, and 13 that more or less fit into chambers 4, 5, and 6, which they enter into as stopper 8 is advanced toward the piece. Partitioning walls 2 and 3 and overall cross-section 1 are accordingly secured radially, the overall piece being introduced against and correctly positioned in relation to each stopper 8. Gasket 10 and aligners 11, 12, and 13 can now attach the schematically illustrated connectors 14, 15, and 16 to stopper 8. Connectors 14, 15, and 16 can also convey the fluid that provides the reshaping pressure.

To ensure a well controlled buckling or bulging out by walls 2, 3, and 7, they are provided with slots 17 more or less paralleling the inner surface 18 or outer surface of cross-section 1. The slot 17 in the illustrated example is very near inner surface 18. These slots are preferably produced by an appropriately shaped bit on stopper 8 as the stoppers are brought together.

Figure 4:
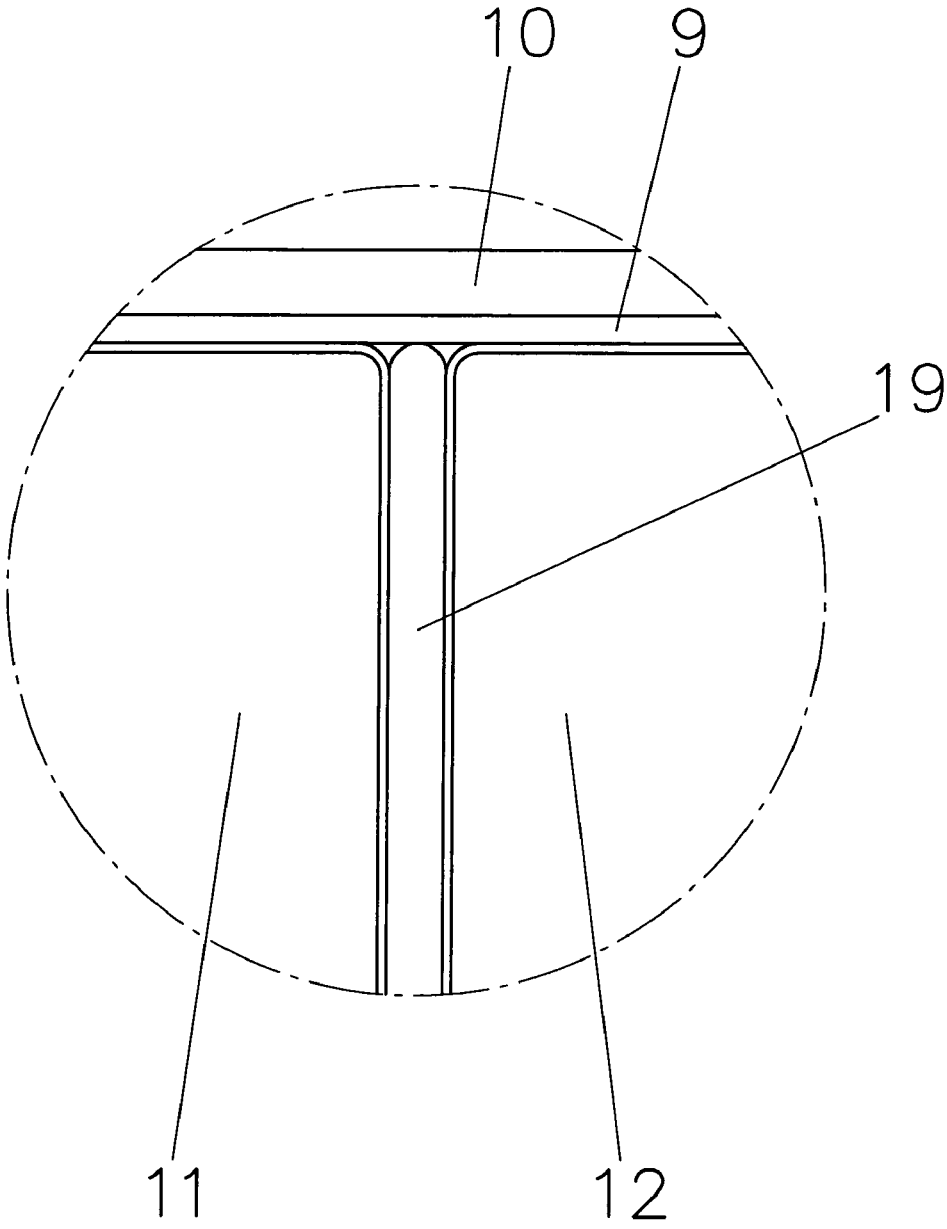
FIG. 4 is a larger-scale view of detail IV in FIG. 3.

FIG. 4 illustrates an alternative or additional embodiment of the present invention. Gasket 10 is in this embodiment provided with grooves 19 extendng along the walls 2 and 3 that partition cross section 1. Grooves 19 allow partitioning walls 2 and 3 to stretch axially without buckling or bulging as the section is reshaped. Since the independent wall 7 that extends out of cross-section 1 does not rest against stopper 8, the measures addressing this wall in the foregoing will obviously not be necessary. What is on the other hand essential is that grooves 19 do not extend all the way to edge 9, providing the overall structural section with a well defined continuous seal.

LIST OF PARTS

1. overall cross-section
2. partitioning wall
3. partitioning wall
4. chamber
5. chamber
6. chamber
7. independent wall
8. stopper
9. seal-creating edge
10. gasket
11. aligner
12. aligner
13. aligner
14. connector
15. connector
16. connector
17. slot
18. inner surface
19. groove

The invention claimed is:

1. A method for reshaping under high interior pressure a structural section having walls of a continuously bounded overall crosssection with ends and at least one supplemental wall, comprising the steps of: forcing a stopper radially against each of said ends; sealing said structural section with said stopper only to said continuously bounded overall crosssection, said at least one supplemental wall comprising a plurality of walls with an independent wall and partitioning walls; and providing said walls with slots at an inner surface or an outer surface of said overall cross-section.

2. A method as defined in claim 1, wherein said slots are less than 1 cm deep.

3. A method as defined in claim 1, wherein said supplemental wall forms chambers, said structural section having intermediate walls with intersections and wall branches; and providing said chambers with slots at said intersections and said wall branches.

4. An arrangement for reshaping a structural section of a continuously bounded overall cross-section with ends, comprising: a stopper forced radially against said ends; at least one supplemental wall in addition to said overall crosssection; said stopper sealing said structural section only at said continuously bounded overall cross-section; said stopper having grooves matching a shape of said wall.

5. An arrangement as defined in claim 4, wherein said grooves extend substantially to said continuously bounded overall cross-section.

6. An arrangement as defined in claim 4, wherein said grooves are less than 1 cm deep.

7. An arrangement as defined in claim 4, including partitioning walls with intersections and wall branches, and grooves at said intersections and said wall branches of said partitioning walls.

8. A method for reshaping with high interior pressure a structural section having walls and a continuously bounded overall crosssection, ends and at least one supplemental wall forming chambers, said method comprising the steps of: forcing a stopper radially against each of said ends; providing said at least one supplemental wall with slots paralleling substantially an inner surface or an outersurface of said cross-section; and sealing said structural section with at an inner surface or an outer surface of said overall cross-section.

* * * * *